US007954558B2

(12) United States Patent
Lane et al.

(10) Patent No.: US 7,954,558 B2
(45) Date of Patent: Jun. 7, 2011

(54) DEVICES AND METHODS FOR POWER CONTROL IN HORIZONTAL DIRECTIONAL DRILLING

(75) Inventors: Philip R. Lane, Pella, IA (US); Douglas Peirce, Pleasant Hill, IA (US)

(73) Assignee: Vermeer Manufacturing Company, Pella, IA (US)

( * ) Notice: Subject to any disclaimer, the term of this patent is extended or adjusted under 35 U.S.C. 154(b) by 127 days.

(21) Appl. No.: 12/252,883

(22) Filed: Oct. 16, 2008

(65) Prior Publication Data

US 2009/0095527 A1 Apr. 16, 2009

Related U.S. Application Data

(60) Provisional application No. 60/999,325, filed on Oct. 16, 2007.

(51) Int. Cl.

| | |
|---|---|
| ***E21B 44/00*** | (2006.01) |
| ***E21B 3/00*** | (2006.01) |
| ***E21B 7/04*** | (2006.01) |
| ***E21B 44/06*** | (2006.01) |
| ***E21B 44/04*** | (2006.01) |
| ***E21B 44/02*** | (2006.01) |
| ***F16D 31/02*** | (2006.01) |

(52) U.S. Cl. ..... 175/25; 60/431

(58) Field of Classification Search ..... 175/61, 175/62, 162, 170, 202, 203; 60/431, 449, 60/428

See application file for complete search history.

(56) References Cited

U.S. PATENT DOCUMENTS

| | | | | |
|---|---|---|---|---|
| 4,008,004 | A * | 2/1977 | Shaw | 417/216 |
| 4,763,473 | A | 8/1988 | Ziplies et al. | |
| 2001/0050186 | A1 | 12/2001 | Wilson et al. | |
| 2006/0185899 | A1 * | 8/2006 | Alft et al. | 175/24 |

FOREIGN PATENT DOCUMENTS

| | | |
|---|---|---|
| DE | 9402360 U1 | 12/1994 |
| WO | WO 97/47858 | 12/1997 |

* cited by examiner

*Primary Examiner* — David J Bagnell
*Assistant Examiner* — James G Sayre
(74) *Attorney, Agent, or Firm* — Hollingsworth & Funk, LLC

(57) ABSTRACT

The present disclosure is directed to methods and apparatuses for controlling pump power draw from an engine in horizontal directional drilling. Various embodiments of the invention are directed to a horizontal directional drilling machine that comprises an engine that outputs mechanical energy, a rotation pump that draws upon the mechanical energy output by the engine to operate a rotation motor that rotates a drill string, a thrust pump that draws upon the mechanical energy output by the engine to operate a thrust motor that longitudinally moves the drill string, a mud pump that draws upon the mechanical energy output by the engine to operate a mud motor that delivers fluid through the drill string, and control circuitry comprising a controller and memory, the processor configured to execute program instructions stored on the memory, processor execution of the stored program instructions causing the control circuitry to calculate a rotation pump power draw from the engine, calculate a thrust pump power draw from the engine, calculate a mud pump power draw from the engine, calculate a total power draw based on the rotation pump power draw, the thrust pump power draw and the mud pump power draw, compare the total power draw to a threshold, and decrease mechanical energy draw of each of the rotation pump, the thrust pump, and the mud pump from the engine based on the total power draw exceeding the threshold.

18 Claims, 3 Drawing Sheets

DEVICES AND METHODS FOR POWER CONTROL IN HORIZONTAL DIRECTIONAL DRILLING

RELATED APPLICATIONS

This application claims the benefit of Provisional Patent Application Ser. No. 60/999,325, filed on Oct. 16, 2007, to which Applicant claims benefit of priority under 35 U.S.C. §119(e), and which is incorporated herein by reference in its entirety.

FIELD OF THE INVENTION

The present invention relates generally to methods and equipment used for horizontal ground boring; more specifically to a method and apparatus for managing pump power draw from an engine.

BACKGROUND OF THE INVENTION

Utility lines for water, electricity, gas, telephone, and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench may pose a danger of injury to workers and passersby.

The general technique of boring a horizontal underground hole has recently been developed in order to overcome the disadvantages described above, as well as others unaddressed when employing conventional trenching techniques. In accordance with such a horizontal boring technique, also known as horizontal directional drilling (HDD) or trenchless underground boring, a boring system is situated on the ground surface and drills a hole into the ground at an oblique angle with respect to the ground surface.

The HDD process includes a pilot hole-boring step. In this step a bore hole is created that extends underground—generally horizontally or generally parallel to the surface of the earth—starting at a launch point and ending at a termination point. The bore hole is created by positioning a boring machine to rotate and push a drill string through the ground. A drill bit is attached to the leading end of the drill string. The drill string is created by connecting individual drill rods together end-to-end from a supply of drill rods stored on the boring machine. The connection between the rods is made up, and subsequently broken in a later step, by the boring machine.

A drilling fluid can be flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the earth's surface. A reamer is then attached to the drill string which is pulled back through the borehole, thus reaming out the borehole to a larger diameter. It is common to attach a utility line or other conduit to the reaming tool so that it is dragged through the borehole along with the reamer.

Another technique associated with horizontal directional drilling, often referred to as push reaming, involves attaching a reamer to the drill string at the entry side of a borehole after the boring tool has exited at the exit side of the borehole. The reamer is then pushed through the borehole while the drill rods being advanced out of the exit side of the borehole are individually disconnected at the exit location of the borehole. A push reaming technique is sometimes used because it advantageously provides for the recycling of the drilling fluid. The level of direct operator interaction with the drill string, such as is required to disconnect drill rods at the exit location of the borehole, is much greater than that associated with traditional horizontal directional drilling techniques.

SUMMARY OF THE INVENTION

The present disclosure relate to a system and method of automatically avoiding engine overload in HDD. Horizontal directional drilling machines can include an engine that powers a number of hydraulic motors. For example, one hydraulic motor can be use to thrust or pull the drill string, another hydraulic motor can be used to rotate the drill string, and yet another hydraulic motor can be used to run a mud pump. The hydraulic motors draw power from the engine through separate pumps and hydraulic fluid circuits. The present invention provides a control method and system that prevents the engine from being overloaded by the multiple hydraulic pumps.

Various embodiments of the invention are directed to a horizontal directional drilling machine that comprises an engine that outputs mechanical energy through a rotation shaft, a rotation pump that draws upon the mechanical energy output by the engine through rotation of the rotation shaft to operate a rotation motor that rotates a drill string by pressurization of a rotation hydraulic fluid circuit between the rotation pump and the rotation motor, a thrust pump that draws upon the mechanical energy output by the engine through rotation of the rotation shaft to operate a thrust motor that longitudinally moves the drill string by pressurization of a thrust hydraulic fluid circuit between the thrust pump and the thrust motor, a mud pump that draws upon the mechanical energy output by the engine through rotation of the rotation shaft to operate a mud motor that delivers fluid through the drill string by pressurization of a mud hydraulic fluid circuit between the mud pump and the mud motor, a rotation hydraulic fluid sensor that outputs a rotation pressure signal indicative of hydraulic fluid pressure within the rotation hydraulic fluid circuit, a thrust hydraulic fluid sensor that outputs a thrust pressure signal indicative of hydraulic fluid pressure within the thrust hydraulic fluid circuit, a mud hydraulic fluid sensor that outputs a mud pressure signal indicative of hydraulic fluid pressure within the mud hydraulic fluid circuit, a sensor that outputs a rotation signal indicative of rotation rate of the rotation shaft, and control circuitry comprising a processor and memory, the processor configured to execute program instructions stored in the memory, processor execution of the stored program instructions causing the control circuitry to control power draw of the rotation pump from the mechanical energy output by the engine, control power draw of the thrust pump from the mechanical energy output by the engine, control power draw of the mud pump from the mechanical energy output by the engine, calculate a rotation pump power draw from the engine based on the rotation pressure signal and the rotation signal, calculate a thrust pump power draw from the engine based on the thrust pressure signal and the rotation signal, calculate a mud pump power draw from the engine based on the mud pressure signal and the rotation signal, calculate a total power draw based on the rotation pump power draw, the thrust pump power draw and the mud pump power draw, compare the total power draw to a threshold associated with output capacity of the engine, and decrease mechanical energy draw from the engine of each of the rotation pump, the thrust pump, and the mud pump based on the total power draw exceeding the threshold.

Such embodiments may include a user interface comprising a rotation user input configured to output a rotation signal based on user input, a thrust user input configured to output a thrust signal based on user input, and a mud user input configured to output a mud signal based on user input, wherein processor execution of the stored program instructions causes the control circuitry to control power draw of the rotation pump based on the rotation signal, control power draw of the thrust pump based on the thrust signal, control power draw of the mud pump based on the mud signal, and wherein power draw of the rotation pump, power draw of the thrust pump, and power draw of the mud pump are each moderated from user input levels based on the total power draw exceeding the threshold.

In such embodiments, processor execution of the stored program instructions may cause the control circuitry to decrease by a proportional amount the mechanical energy draw of each of the rotation pump, the thrust pump, and the mud pump from the engine based on the total power draw exceeding the threshold.

In such embodiments, processor execution of the stored program instructions may cause the control circuitry to decrease the mechanical energy draw of each of the rotation pump, the thrust pump, and the mud pump in different amounts based on the total power draw exceeding the threshold.

Such embodiments may comprise an engine temperature sensor that outputs a temperature signal indicative of coolant temperature of the engine, wherein processor execution of the stored program instructions may cause the control circuitry to decrease mechanical energy draw of each of the rotation pump, the thrust pump, and the mud pump from the engine based on the coolant temperature of the engine exceeding a temperature threshold as indicated by the temperature signal.

Such embodiments may comprise an engine load sensor that outputs a load signal indicative of load on the engine, wherein processor execution of the stored program instructions may cause the control circuitry to calculate an engine revolutions per minute parameter based on the rotation signal, and decrease mechanical energy draw of each of the rotation pump, the thrust pump, and the mud pump from the engine based on the engine revolutions per minute parameter exceeding a engine revolutions per minute threshold as indicated by the rotation signal.

In such embodiments, processor execution of the stored program instructions may cause the control circuitry to calculate a rotation hydraulic fluid flow rate of hydraulic fluid in the rotation hydraulic fluid circuit, calculate a thrust hydraulic fluid flow rate of hydraulic fluid in the thrust hydraulic fluid circuit, calculate a mud hydraulic fluid flow rate of hydraulic fluid in the mud hydraulic fluid circuit, and wherein calculation of the rotation pump power draw is based on the rotation hydraulic fluid flow rate, calculation of the thrust pump power draw is based on the thrust hydraulic fluid flow rate, and calculation of the mud pump power draw is based on the mud hydraulic fluid flow rate.

Various embodiments of the invention are directed to a horizontal directional drilling machine that comprises an engine that outputs mechanical energy, a rotation pump that draws upon the mechanical energy output by the engine to operate a rotation motor that rotates a drill string, a thrust pump that draws upon the mechanical energy output by the engine to operate a thrust motor that longitudinally moves the drill string, a mud pump that draws upon the mechanical energy output by the engine to operate a mud motor that delivers fluid through the drill string, and control circuitry comprising a controller and memory, the processor configured to execute program instructions stored on the memory, processor execution of the stored program instructions causing the control circuitry to calculate a rotation pump power draw from the engine, calculate a thrust pump power draw from the engine, calculate a mud pump power draw from the engine, calculate a total power draw based on the rotation pump power draw, the thrust pump power draw and the mud pump power draw, compare the total power draw to a threshold, and decrease mechanical energy draw of each of the rotation pump, the thrust pump, and the mud pump from the engine based on the total power draw exceeding the threshold.

Such embodiments may comprise a first sensor that outputs a first parameter signal indicative of a first hydraulic fluid parameter of hydraulic fluid pumped by the rotation pump, a second sensor that outputs a second parameter signal indicative of a second hydraulic fluid parameter of hydraulic fluid pumped by the thrust pump, and a third sensor that outputs a third parameter signal indicative of a third hydraulic fluid parameter of hydraulic fluid pumped by the mud pump, wherein processor execution of the stored program instructions may cause the control circuitry to calculate the rotation pump power draw based on the first parameter signal, calculate the thrust pump power draw based on the second parameter signal, and calculate the mud pump power draw based on the third parameter signal.

In such embodiments, the first hydraulic fluid parameter may be hydraulic fluid flow rate output by the rotation pump, the second hydraulic fluid parameter may be hydraulic fluid flow rate output by the thrust pump, and the third hydraulic fluid parameter may be hydraulic fluid flow rate output by the mud pump.

In such embodiments, processor execution of the stored program instructions may cause the control circuitry to decrease mechanical energy draw of each of the rotation pump, the thrust pump, and the mud pump from the engine in equal portion based on the total power draw exceeding the threshold.

In such embodiments, processor execution of the stored program instructions may cause the control circuitry to decrease mechanical energy draw of each of the rotation pump, the thrust pump, and the mud pump from the engine in unequal portion based on the total power draw exceeding the threshold.

Such embodiments may comprise a user interface comprising a rotation input configured to output a rotation command signal, a thrust input command signal, and a mud input command signal, wherein processor execution of the stored program instructions may cause the control circuitry to control the energy draw of the rotation pump based on the rotation command signal, control the energy draw of the thrust pump based on the thrust command signal, and control the energy draw of the mud pump based on the mud command signal, wherein the energy draw of the rotation pump, the energy draw of the thrust pump, and the energy draw of the mud pump can be each moderated from user input levels by the control circuitry based on the total power draw exceeding the threshold.

Such embodiments may further comprise an engine coolant temperature sensor configured to output a temperature signal indicative of coolant fluid temperature of the engine, wherein processor execution of the stored program instructions may cause the control circuitry to decrease mechanical energy draw of each of the rotation pump, the thrust pump, and the mud pump from the engine if the coolant fluid temperature exceeds a temperature threshold based on the temperature signal.

Various embodiments of the present invention are directed to a method for controlling pump power draw from an engine in a horizontal directional drilling machine, the method comprising providing a directional drilling machine having an engine that outputs mechanical energy, a rotation pump that draws upon the mechanical energy output by the engine to operate a rotation motor that rotates a drill string, a thrust pump that draws upon the mechanical energy output by the engine to operate a thrust motor that longitudinally moves the drill string, a mud pump that draws upon the mechanical energy output by the engine to operate a mud motor that delivers fluid through the drill string, sensing a first signal indicative of a first hydraulic fluid parameter of hydraulic fluid pumped by the rotation pump, sensing a second signal indicative of a second hydraulic fluid parameter of hydraulic fluid pumped by the thrust pump, sensing a third signal indicative of a third hydraulic fluid parameter of hydraulic fluid pumped by the mud pump, determining a rotation pump power draw from the mechanical energy output by the engine based on the first signal, determining a thrust pump power draw from the mechanical energy output by the engine based on the second signal, determining a mud pump power draw from the mechanical energy output by the engine based on the third signal, determining a total pump power draw based on the rotation pump power draw, the thrust pump power draw, and the mud pump power draw, comparing the total pump power draw to a threshold associated with output capacity of the engine, and decreasing power draw of each of the rotation pump, the thrust pump, and the mud pump from the engine based on the total pump power draw exceeding the threshold.

In such embodiments, the first hydraulic fluid parameter may be hydraulic fluid flow rate output by the rotation pump, the second hydraulic fluid parameter may be hydraulic fluid flow rate output by the thrust pump, and the third hydraulic fluid parameter may be hydraulic fluid flow rate output by the mud pump.

In such embodiments, decreasing power draw from the engine for each of the rotation pump, the thrust pump, and the mud pump may further comprise decreasing power draw in equal portion between the rotation pump, the thrust pump, and the mud pump.

In such embodiments, decreasing power draw from the engine for each of the rotation pump, the thrust pump, and the mud pump may further comprise decreasing power draw in unequal portion between the rotation pump, the thrust pump, and the mud pump.

Such embodiments may further comprise receiving a rotation input parameter from a first user manipulated input, receiving a thrust input parameter from a second user manipulated input, receiving a mud input parameter from a third user manipulated input;

controlling power draw by the rotation pump from the engine based on the rotation input parameter, controlling power draw by the thrust pump from the engine based on the thrust input parameter, controlling power draw by the mud pump from the engine based on the mud input parameter, and modifying each of the rotation input parameter, the thrust input parameter, and the mud input parameter to decrease power draw of each of the rotation pump, the thrust pump, and the mud pump from the engine based on the total power energy draw exceeding the threshold.

Such embodiments may further include receiving a engine coolant temperature signal indicative of engine coolant temperature of the engine, and decreasing energy draw of each of the rotation pump, the thrust pump, and the mud pump from the engine based on the coolant fluid temperature exceeding a temperature threshold based on the engine coolant temperature signal.

Various embodiments are directed to a horizontal directional drilling machine having an engine that outputs mechanical energy, a rotation pump that draws upon the mechanical energy output by the engine to operate a rotation motor that rotates a drill string, a thrust pump that draws upon the mechanical energy output by the engine to operate a thrust motor that longitudinally moves the drill string, a mud pump that draws upon the mechanical energy output by the engine to operate a mud motor that delivers fluid through the drill string, means for calculating a rotation pump power draw from the engine, means for calculating a thrust pump power draw from the engine, means for calculating a mud pump power draw from the engine, means for calculating a total power draw based on the rotation pump power draw, the thrust pump power draw and the mud pump power draw, means for comparing the total power draw to a threshold, and means for decreasing mechanical energy draw of each of the rotation pump, the thrust pump, and the mud pump from the engine based on the total power draw exceeding the threshold.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
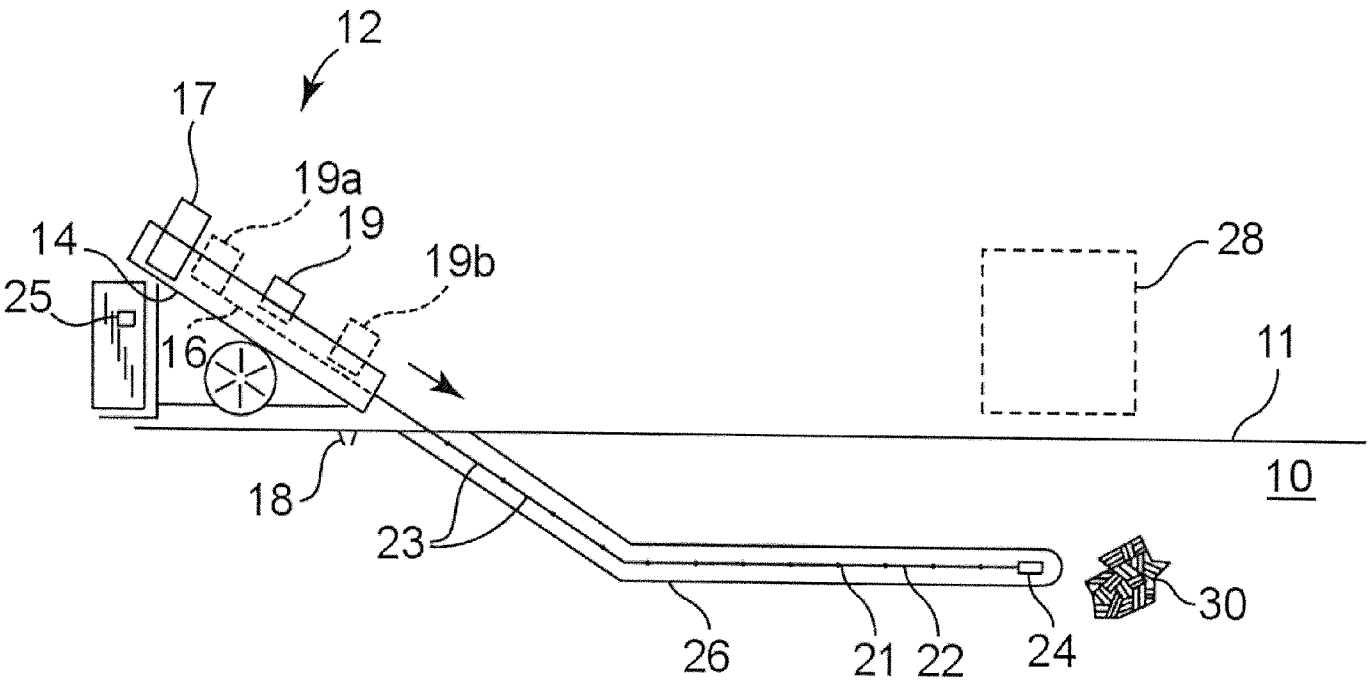
FIG. 1 illustrates various components of a drilling system and a ground cross section showing down hole boring components in accordance with various embodiments of this disclosure.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF VARIOUS EMBODIMENTS

In the following description of the illustrated embodiments, references are made to the accompanying drawings forming a part hereof, and in which are shown by way of illustration, various embodiments by which the invention may be practiced. It is to be understood that other embodiments may be utilized, and structural and functional changes may be made without departing from the scope of the present invention.

Systems, devices or methods according to the present invention may include one or more of the features, structures, methods, or combinations thereof described herein. For example, a device or system may be implemented to include one or more of the advantageous features and/or processes described below. It is intended that such a device or system need not include all of the features described herein, but may be implemented to include selected features that provide for useful structures and/or functionality.

FIG. 1 illustrates a cross-section through a portion of ground 10 where a HDD boring operation takes place. The underground boring system, generally shown as the machine 12, is situated aboveground 11 and includes a platform 14 on which is situated a tilted longitudinal member 16. The platform 14 is secured to the ground by pins 18 or other restraining members in order to resist platform 14 movement during the boring operation. Located on the longitudinal member 16 is a thrust/pullback motor 17 for driving a drill string 22 in a forward, longitudinal direction as generally shown by the arrow. The drill string 22 is made up of a number of drill string members 23 attached end-to-end. Also located on the tilted longitudinal member 16, and mounted to permit movement along the longitudinal member 16, is a rotation motor 19 for rotating the drill string 22 (illustrated in an intermediate position between an upper position 19*a* and a lower position 19*b*). In operation, the rotation motor 19 rotates the drill string 22 which has a boring tool 24 attached at the end of the drill string 22.

A tracker unit 28 may be employed to receive an information signal transmitted from boring tool 24 which, in turn, communicates the information signal or a modified form of the signal to a receiver situated at the boring machine 12. The boring machine 12 may also include a transmitter or transceiver for purposes of transmitting and/or receiving an information signal, such as an instruction signal, from the boring machine 12 to the tracker unit 28. Transmission of data and instructions may alternatively be facilitated through use of a communication link established between the boring tool 24 and central processor 25 via the drill string 22.

A boring operation can take place as follows. The rotation motor 19 is initially positioned in an upper location 19*a* and rotates the drill string 22. While the boring tool 24 is rotated through rotation of the drill string 22, the rotation motor 19 and drill string 22 are pushed in a forward direction by the thrust/pullback motor 17 toward a lower position into the ground, thus creating a borehole 26. The rotation motor 19 reaches a lower position 19*b* when the drill string 22 has been pushed into the borehole 26 by the length of one drill string member 23. A new drill string member 23 is then added to the drill string 22 either manually or automatically, and the rotation motor 19 is released and pulled back to the upper location 19*a*. The rotation motor 19 is used to thread the new drill string member 23 to the drill string 22, and the rotation/push process is repeated so as to force the newly lengthened drill string 22 further into the ground, thereby extending the borehole 26. Commonly, water or other fluid is pumped through the drill string 22 (often in a mixture refereed to herein as mud) by use of a mud motor. If an air hammer is used, an air compressor is used to force air/foam through the drill string 22. The mud or air/foam flows back up through the borehole 26 to remove cuttings, dirt, and other debris and improve boring effectiveness and/or efficiency. A directional steering capability is typically provided for controlling the direction of the boring tool 24, such that a desired direction can be imparted to the resulting borehole 26.

Manual controls can be used to control the rotation motor 19, thrust/pullback motor 17, and mud motor to provide respective outputs as desired. For example, a joystick can be used by a user to control the thrust/pullback motor 17 output to advance and retract the drill string 23. Another joystick can be used to control the rotation motor 19. Similarly, a user control can be employed to control the level of mud delivery through the drill string. In each of these cases, signals from the respective user inputs are received by one or more controllers that control operation of the motors and/or pumps that power the motors.

In various HDD systems several motors are used to rotate the drill string, advance/retract the drill string, and drive mud through the drill string. For example, a rotation motor can rotate the drill string, a thrust/pull back motor can advance/retract a drill string, and a mud motor can drive fluid through the drill string. Each of these motors are powered by hydraulic fluid flowing through respective hydraulic fluid circuits. Hydraulic fluid flow in these respective circuits is created by respective pumps drawing mechanical energy from a common engine.

For example, a HDD rig may have an engine powered by electricity or combustible fuel, the engine outputting mechanical motion (kinetic energy). The mechanical motion is drawn upon by separate pumps to force hydraulic fluid through the respective circuits and power the respective motors. The pumps convert the mechanical motion from the engine (typically rotational motion) to another form of energy (typically hydraulic pressure). The energy converted by the pump can then operate the various rotation, thrusting, and fluid delivery functions of the HDD rig.

Operating a HDD system distributing power in this way can have several advantages. For example, only one engine and fuel input is needed, whereas other systems may have separate engines for rotation, thrusting, and mud delivery functions. Moreover, a relatively large engine can be used, allowing much of the power of the engine to be focused on a single task when needed. For example, if high speed rotation is needed for certain grinding functions, than a single engine HDD rig can devote practically all of its power resources to rotating the drill string. In this way, a single engine HDD rig can provide more powerful drill string rotation, thrust, retraction, or fluid delivery relative to multiengine embodiments.

However, while a single engine HDD rig can manage power resources to flexibly specialize in any one function as needed, multitasking performance can complicate distribution of power from the engine. The engine can become overwhelmed if the draw from each of the pumps combine to demand more than the engine can deliver. For example, a user may manipulate a joystick controlling rotation of the drill string to demand that the rotation pump powering the rotation motor output at 100% of its capacity while the user also manipulates another joystick controlling thrust of the drill string to demand that the thrust pump powering the thrust motor output at 70% of its capacity, exceeding the total amount of power that the engine can deliver. In such a case, engine output can decline, or the engine can stall, causing unpredictable and uncoordinated diminishment of energy to the motors via the pumps.

Method and system embodiments of the present disclosure address these and other problems by monitoring parameters from the pumps, calculating a total power demand by the motors, comparing the total demand to the power output capacity of the engine, and moderating control signals to the pumps to prevent overdrawing power from the engine.

Figure 2:
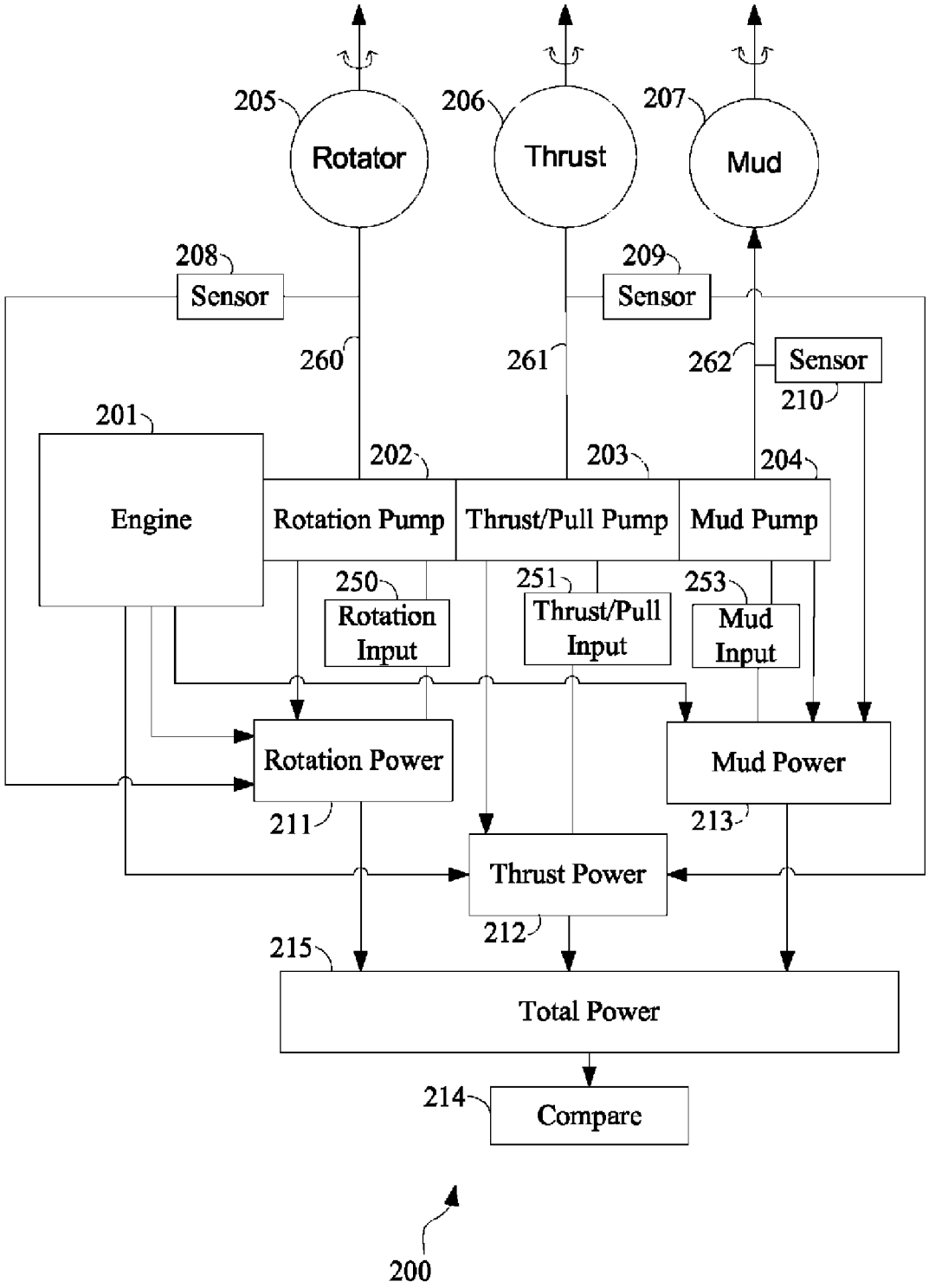
FIG. 2 illustrates a chart showing aspects of power management in horizontal directional drilling in accordance with various embodiments of this disclosure.

FIG. 2 illustrates an embodiment for managing pump draw from an engine in a HDD system 200. Engine 201 converts storable energy, such as gasoline, to mechanical energy, and outputs the mechanical energy in the form of rotation. The rotation pump 202, thrust/pull pump 203, and mud pump 204 each piggyback on one another. The rotation pump 202, thrust/pull pump 203, and mud pump 204 each can be independently controlled by control signals to variably draw upon the mechanical energy output by the engine 201.

Depending on how much energy each motor 202-204 draws from the engine 201 based on control signals, the rotation motor 205, thrust motor 206, and mud motor 207 can be controlled to respectively rotate a drill string, advance/retract the drill string, and deliver fluid through the drill string. For example, the rotation pump 202 responds to control signals to draw some amount of mechanical energy from the engine 201 output to circulate hydraulic fluid in a rotation hydraulic fluid circuit 260. The pressure of hydraulic fluid created by the rotation pump 202 in the rotation hydraulic fluid circuit 260 is used by the rotation motor 205 to rotate the drill string. Likewise, the pressure of hydraulic fluid created by the thrust pump 203 in the thrust hydraulic fluid circuit 261 is used by the thrust motor 206 to advance/retract the drill string, and the pressure of hydraulic fluid created by the mud pump 203 in the mud hydraulic fluid circuit 262 is used by the mud motor 207 to deliver a fluid through the drill string and into the bore hole.

The different hydraulic fluid circuits 260-262 allow for different pressurizations and flow rates respectively appropriate for the rotation motor 205, thrust motor 206, and mud motor 207. Sensors 208-210 respectively monitor parameters of the respective hydraulic circuits 260-262. The sensors 208-210 can sense various parameters associated with motor outputs, such as hydraulic pressure (pounds per square inch; PSI) and hydraulic fluid flow rate (gallons per minute; GPM), among others. Sensors 208-210 provide feedback information concerning these parameters to monitoring circuits 211-213, respectively. Information from the engine 201, such as revolutions per minute of the output shaft feeding the pump 202-204, can also be provided to the monitoring circuits 211-213.

The respective energy draws from the rotation pump 202, thrust/pull pump 203, and mud pump 204 are controlled in part by control signals from the rotation input 250, thrust/pull input 251, and mud input 253, respectively. The input information is also provided to each of the respective monitoring circuits 211-213.

The monitoring circuits 211-213 can respectively use the information provided by the sensors 208-210, pumps 202-204, and control inputs 250-253 to respectively calculate power draw on the engine 201 from each of the pumps 202-204. The power draw information is then summed 215 and compared 214 to information associated with the engine 201. For example, one or more thresholds can be saved in memory and the total power draw calculation 215 can be compared 214 to the threshold. The threshold can be associated with the maximum power output of the engine 201, such as 95% of the maximum power output of the engine 201.

A total power draw 215 exceeding a threshold 214 associated with the maximum power output of the engine 201 can indicate that the power draw is about to exceed engine 201 capacity, threatening to stall the engine 201 or otherwise degrade engine 201 performance. The HDD system 200 can respond to this by reducing the control inputs 250-253, moderating the motors 202-204 (e.g., decreasing power draw), which can override user input directing rotation, thrust, and mud delivery.

The pump power draw reduction from the engine 201 can be done uniformly for each pump 202-204. In some cases, when a total draw 215 threshold is reached 214 each of the pumps 202-204 could be destroked an amount corresponding to a % of its respective capacity. For example, if the rotation pump 202 is operating at 60% of its capacity, the thrust pump 203 is operating at 20% of its capacity, and the mud pump 204 is operating at 15% of its capacity, then each of these pumps 202-204 could be destroked by 10% of their respective operating capacities.

In some embodiments, the pumps 202-204 could be destroked based on their current operating levels, such as a percentage of current operating level. For example, power draw is calculated 211-213 for each pump 202-204. Therefore, each pump 202-204 could be destroked by a percentage (e.g., 20%) of their respective current operating power levels. In this way, a pump drawing 30 horse power would be limited to 24 horse power if the power draw of each pump was decreased by 20% based on total motor draw exceeding a threshold.

In some embodiments, the pumps 202-204 could be destroked a standard amount based on power. For example, power draw for each pump 202-204 could be decrease by a horsepower or watt amount as determined by the power calculations 211-213 for each pump 202-204, the power draw amount reduced irrespective of the power draw for any individual pump.

In some embodiments, power draw for each pump could be linearly or exponentially decreased until the calculated total motor draw 215 falls back below a threshold 214, and those control parameters levels input to the pumps 202-204 when the total motor draw 215 fell below the threshold 214 maintained.

In some embodiments, the function of one pump may be favored relative to other pumps, such that the other pumps are destroked before, and/or in greater amount, than the favored pump. Such unequal power draw reduction can preserve the function associated with the favored pump, such as drill string rotation, thrust, or mud delivery. For example, running mud through the bore hole at all times can be a critical function in some HDD applications, as the mud can clear away cuttings and act as a lubricant, thereby reducing machine stress. In such applications, it can be valuable to preserve output of the mud motor 207 relative to the outputs of the rotation motor 205 and the thrust/pull motor 206. This can be accomplished by reducing draw by the non-favored pumps before reducing draw from the favored pump (e.g., mud pump 204 is only destroked if the rotation pump 202 and thrust/pull pump 203 have already been destroked and a total power threshold is still being exceeded). In some embodiments, the favored pump is destroked at the same time as the non-favored pump, but is destroked a lesser amount (e.g., a lesser amount of % of pump or motor capacity or current operating level, or a lesser amount of a predetermined power decrement relative to the other non-favored pumps/motors). In some embodiments, all pumps can be destroked at the same time but at different rates. For example, the mud and thrust pump power draws could be decreased to 10% of user input while the rotation pump could be decreased to only 50% of user input.

After the pump 202-204 draws are reduced based on total power draw 215 exceeding a threshold 214, it is expected that the respective calculated power draws 211-213 would be reduced, as well as the total power draw 215 from the engine 201. However, if the total power draw 215 continues to exceed a threshold after some time, or a higher threshold is exceeded, then pump 202-204 power draws can further be reduced using more aggressive steps, such as greater power draw decrements, until the total power draw 215 falls below a threshold to an acceptable amount within engine 201 output capacity.

As total power draw 215 falls below the threshold, control signals from the inputs 250-253 can be moderated or fully restored to better match the user intended inputs and allow the pumps 202-204 to draw as much power from the engine 201 as indicated by the user via controls.

Figure 3:
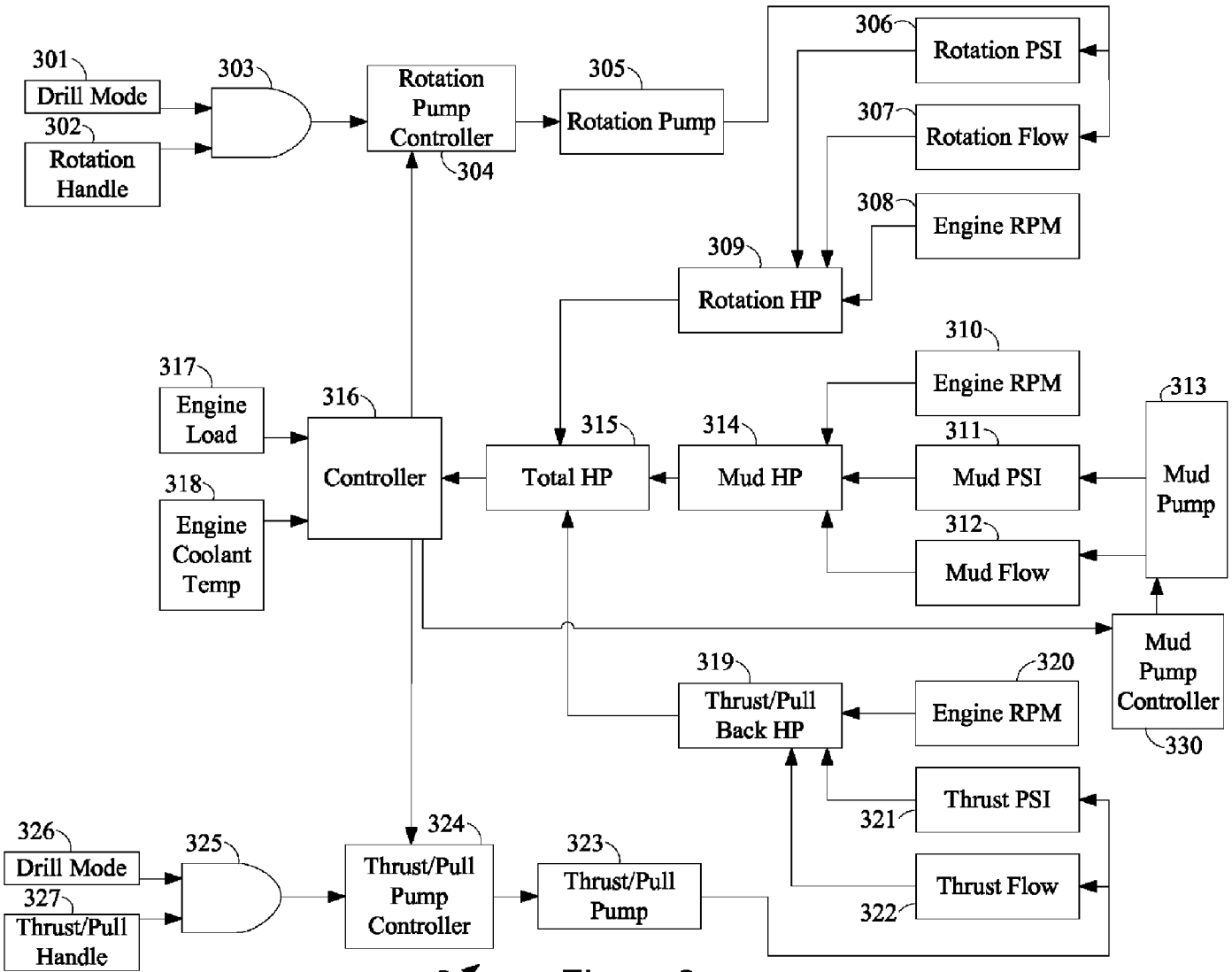
FIG. 3 illustrates a chart showing aspects of power management in horizontal directional drilling in accordance with various embodiments of this disclosure.

FIG. 3 illustrates various aspects of the present disclosure. According to various embodiments, measured variables are used to calculate the amount of horse power that each pump of a plurality draws from an engine. The depicted embodiment of FIG. 3 includes three hydrostatic pumps: a rotation pump 305 driving the rotation of the drill string, a thrust/pull pump 323 driving the thrust and/or pullback of the drill string, and a mud pump 313 that facilitates delivery of fluids in the bore hole, such as a mud mixture. The operation of the rotation pump 305 is controlled by rotation pump controller 304, which receives control signals from input control 302 (e.g., interfacing with a user joystick/rotation handle), drill mode unit 301 (e.g., based on an automatic drill mode setting) via logic circuit 303, and controller 316. The operation of the thrust/pull pump 323 is controlled by thrust/pull pump controller 324, which receives control signals from input control 327 (e.g., interfacing with a user joystick-thrust/pull handle), drill mode unit 326 (e.g., based on an automatic drill mode setting) via logic circuit 325, and controller 316. Operation of the mud pump 330 can be similarly controlled by a user input and drill mode unit (not pictured).

Each of the pumps consumes some amount of power from an engine. The power consumed by each pump can be estimated by the following equation:

Hydraulic Pump Power=((((Engine RPM/*C*2)×*C*1)×% of hydraulic fluid flow)×Hydraulic Fluid PSI)/1741*C3));wherein:C1=Rated Engine RPM; C2=Actual Pump output flow-rate(GPM)at Rated Engine RPM;and C3=Hydraulic Pump Overall Efficiency(e.g.,0.90=90%).

As shown in the above equation, the rotation pump power calculation 309 depends on the hydraulic pressure 306, hydraulic fluid flow 307 from the rotation pump, and engine RPM 308. The mud pump power calculation 314 depends on the hydraulic pressure 311, hydraulic fluid flow 312 from the mud pump, and engine RPM 310. The thrust pump power calculation 323 depends on the hydraulic pressure 321, hydraulic fluid flow 322 from the thrust pump, and engine RPM 320. Each of the rotation pump power calculation 309, mud pump power calculation 314, and thrust pump power calculation 323 are summed to calculate a total power 315 demand. A controller 316 compares the total power 315 demand to one or more stored thresholds, such as maximum engine output. In some embodiments, controller 316 runs a proportional integral loop to compare total power 316 parameter to an engine parameter.

In the event that the controller 316 determines that the total power 315 draw from the pumps 304, 313, and 324 exceeds a threshold, the controller 316 can lower the power inputs for the rotation pump controller 304, thrust/pull pump controller 324, and mud pump controller 330. The power output and the engine power consumption of the rotation pump 305 can be completely controlled by the user control 302 and/or drill mode unit 301 until the threshold is reached, at which time the controller 316 will limit the power output and the engine power consumption of the rotation pump 305. The power output and the engine power consumption of the thrust/pull pump 324 can be completely controlled by the user control 327 and/or drill mode unit 326 until the threshold is breached, at which time the controller 316 will limit the power output and the engine power consumption of the rotation pump 323. The power output and the engine power consumption of the mud pump can be similarly controlled.

The pump controllers (e.g., rotation pump controller 304, thrust/pull controller 324, and mud pump controller 330) can execute algorithms to manage the user input and the controller 316 setting. For example, a joystick input % (e.g., 0-100%) can be multiplied by a power limit % received from the controller 316 (e.g., 0-100%). If 80% rotation power level is input 302 and the controller 316 is limiting pump output to 90% of input 302, then the rotation pump controller 304 can command the rotation pump 305 to output 72% of capacity (e.g., using algorithm: (input % from user)*(destroke % from controller)/100=pump power draw % of capacity of pump). The thrust/pull pump 313 and thrust/pull pump 323 can be similarly controlled to manage user inputs and controller 316 limits. In some embodiments, the drill mode unit 301 input may set the rotation pump 305 output level, in which case the controller 316 can limit the rotation pump 305 output in similar fashion to how the user input 302 is limited. The drill mode unit 326 input associated with thrust, and a drill mode unit input associated with mud delivery, can be limited by the controller in the same ways as the drill mode unit 301 input.

In some embodiments, the controller 316 can limit operation of the rotation, thrust/pull, and mud pumps based on engine load 317 and/or engine coolant temperature 318. In such cases, if the engine load 317 and/or engine coolant temperature 318 exceeds a threshold then the controller 316 can control the rotation pump controller 304, mud pump controller 330, and thrust/pull pump controller 324 to limit operation of the rotation pump 305, mud pump 313, and the thrust/pull pump 324 in any manner discussed herein (e.g., when total power draw by the pumps exceeds a threshold). For example, if the engine is operating at 2400 RPM and the engine RPM then decreases to 1900 RPM and no decrease in engine rotational output was expected, then the draw from the pumps 305, 313, and 323 can be decreased as discussed herein based on the sensed RPM droop.

In some embodiments an operator uses a left joystick input 302 to control the rotation of the drill string and a right joystick input 327 to control the thrust or pull force applied to the drill string. Control signals from the left joystick are sent through a profile function to the rotation pump and control signals from the right joystick are sent through a profile function to a thrust/pull pump. Essentially, the left and right joysticks are used by the operator to input his or her desired actions to the horizontal drilling machine.

In some embodiments, a horse power limiter PI loop determines, based on input data, whether the engine is overloaded. If the engine is overloaded, a control signal from the joysticks to the respective hydraulic pumps is adjusted. In the depicted embodiments the horse power draw from each of the pumps is calculated based on the sensed engine revolutions per minute (RMP), hydraulic fluid pressure (PSI), and hydraulic fluid flow rate. The horse power draw from each of the pumps and the total horse power draw can be sent to the HP limiter PI loop. The loop prevents the user from requesting from the pumps more power than the engine is able to deliver.

While operating in drill mode, hydraulic system power requirements of a HDD machine may exceed engine output power capabilities. In effort to reduce or avoid engine overload the present disclosure provides control system. One embodiment of the control system is configured to monitor hydraulic power, engine percent load (J1939), and engine coolant temperature.

If any of these three variables are above their respective limits the control signal to the hydraulic system are modulated to control the 'above-limit' variable. As the 'above-limit' variable falls back below its respective limit the control system allows the control signals to the hydraulic system to rise back up their original values.

Embodiments of the invention can use a controller having memory coupled to a processor to perform the methods and functions described here. Memory can be a computer readable medium encoded with a computer program, software, computer executable instructions, instructions capable of being executed by a computer, etc, to be executed by circuitry, such as processor of a machine controller. For example, memory can be a computer readable medium storing a computer program, execution of the computer program by processor causing a HDD system to perform the steps referenced herein, such as those concerning managing pump power draw from an engine.

The discussion and illustrations provided herein are presented in an exemplary format, wherein selected embodiments are described and illustrated to present the various aspects of the present invention. Systems, devices, or methods according to the present invention may include one or more of the features, structures, methods, or combinations thereof described herein. For example, a device or system may be implemented to include one or more of the advantageous features and/or processes described below. A device or system according to the present invention may be implemented to include multiple features and/or aspects illustrated and/or discussed in separate examples and/or illustrations. It is intended that such a device or system need not include all of the features described herein, but may be implemented to include selected features that provide for useful structures, systems, and/or functionality.

Although only examples of certain functions may be described as being performed by circuitry for the sake of brevity, any of the functions, methods, and techniques can be performed using circuitry and methods described herein, as would be understood by one of ordinary skill in the art.

We claim:

1. A horizontal directional drilling machine having power control, comprising:

an engine that outputs mechanical energy through a rotation shaft;

a rotation pump that draws upon the mechanical energy output by the engine through rotation of the rotation shaft to operate a rotation motor that rotates a drill string by pressurization of a rotation hydraulic fluid circuit between the rotation pump and the rotation motor;

a thrust pump that draws upon the mechanical energy output by the engine through rotation of the rotation shaft to operate a thrust motor that longitudinally moves the drill string by pressurization of a thrust hydraulic fluid circuit between the thrust pump and the thrust motor;

a mud pump that draws upon the mechanical energy output by the engine through rotation of the rotation shaft to operate a mud motor that delivers fluid through the drill string by pressurization of a mud hydraulic fluid circuit between the mud pump and the mud motor;

a rotation hydraulic fluid sensor that outputs a rotation pressure signal indicative of hydraulic fluid pressure within the rotation hydraulic fluid circuit;

a thrust hydraulic fluid sensor that outputs a thrust pressure signal indicative of hydraulic fluid pressure within the thrust hydraulic fluid circuit;

a mud hydraulic fluid sensor that outputs a mud pressure signal indicative of hydraulic fluid pressure within the mud hydraulic fluid circuit;

a sensor that outputs a rotation signal indicative of rotation rate of the rotation shaft; and control circuitry comprising a processor and memory, the processor configured to execute program instructions stored in the memory, processor execution of the stored program instructions causing the control circuitry to control power draw of the rotation pump from the mechanical energy output by the engine, control power draw of the thrust pump from the mechanical energy output by the engine, control power draw of the mud pump from the mechanical energy output by the engine, calculate a rotation pump power draw from the engine based on the rotation pressure signal and the rotation signal, calculate a thrust pump power draw from the engine based on the thrust pressure signal and the rotation signal, calculate a mud pump power draw from the engine based on the mud pressure signal and the rotation signal, calculate a total power draw based on the rotation pump power draw, the thrust pump power draw and the mud pump power draw, compare the total power draw to a threshold associated with output capacity of the engine, and decrease mechanical energy draw from the engine of each of the rotation pump, the thrust pump, and the mud pump based on the total power draw exceeding the threshold, the processor executing the stored program instructions to cause the control circuitry to decrease the mechanical energy draw of each of the rotation pump, the thrust pump, and the mud pump in different amounts based on the total power draw exceeding the threshold.

2. The horizontal directional drilling machine of claim 1, further comprising a user interface comprising:

a rotation user input configured to output a rotation signal based on user input;

a thrust user input configured to output a thrust signal based on user input; and a mud user input configured to output a mud signal based on user input, wherein processor execution of the stored program instructions causes the control circuitry to control power draw of the rotation pump based on the rotation signal, control power draw of the thrust pump based on the thrust signal, control power draw of the mud pump based on the mud signal, and wherein power draw of the rotation pump, power draw of the thrust pump, and power draw of the mud pump are each moderated from user input levels based on the total power draw exceeding the threshold.

3. The horizontal directional drilling machine of claim 1, wherein processor execution of the stored program instructions causes the control circuitry to decrease by a proportional amount the mechanical energy draw of each of the rotation pump, the thrust pump, and the mud pump from the engine based on the total power draw exceeding the threshold.

4. The horizontal directional drilling machine of claim 1, further comprising an engine temperature sensor that outputs a temperature signal indicative of coolant temperature of the engine, wherein processor execution of the stored program instructions causes the control circuitry to decrease mechanical energy draw of each of the rotation pump, the thrust pump, and the mud pump from the engine based on the coolant temperature of the engine exceeding a temperature threshold as indicated by the temperature signal.

5. The horizontal directional drilling machine of claim 1, further comprising an engine load sensor that outputs a load signal indicative of load on the engine, wherein processor execution of the stored program instructions causes the control circuitry to calculate an engine revolutions per minute parameter based on the rotation signal, and decrease mechanical energy draw of each of the rotation pump, the thrust pump, and the mud pump from the engine based on the engine revolutions per minute parameter exceeding a engine revolutions per minute threshold as indicated by the rotation signal.

6. The horizontal directional drilling machine of claim 1, wherein processor execution of the stored program instructions causes the control circuitry to calculate a rotation hydraulic fluid flow rate of hydraulic fluid in the rotation hydraulic fluid circuit, calculate a thrust hydraulic fluid flow rate of hydraulic fluid in the thrust hydraulic fluid circuit, calculate a mud hydraulic fluid flow rate of hydraulic fluid in the mud hydraulic fluid circuit, and wherein calculation of the rotation pump power draw is based on the rotation hydraulic fluid flow rate, calculation of the thrust pump power draw is based on the thrust hydraulic fluid flow rate, and calculation of the mud pump power draw is based on the mud hydraulic fluid flow rate.

7. A horizontal directional drilling machine having power control, comprising:

an engine that outputs mechanical energy;

a rotation pump that draws upon the mechanical energy output by the engine to operate a rotation motor that rotates a drill string;

a thrust pump that draws upon the mechanical energy output by the engine to operate a thrust motor that longitudinally moves the drill string;

a mud pump that draws upon the mechanical energy output by the engine to operate a mud motor that delivers fluid through the drill string; and control circuitry comprising a controller and memory, the processor configured to execute program instructions stored on the memory, processor execution of the stored program instructions causing the control circuitry to calculate a rotation pump power draw from the engine, calculate a thrust pump power draw from the engine, calculate a mud pump power draw from the engine, calculate a total power draw based on the rotation pump power draw, the thrust pump power draw and the mud pump power draw, compare the total power draw to a threshold, and decrease mechanical energy draw of each of the rotation pump, the thrust pump, and the mud pump from the engine based on the total power draw exceeding the threshold, wherein processor execution of the stored program instructions causes the control circuitry to decrease mechanical energy draw of each of the rotation pump, the thrust pump, and the mud pump from the engine in unequal portion based on the total power draw exceeding the threshold.

8. The horizontal direction drilling machine of claim 7, further comprising:

a first sensor that outputs a first parameter signal indicative of a first hydraulic fluid parameter of hydraulic fluid pumped by the rotation pump;

a second sensor that outputs a second parameter signal indicative of a second hydraulic fluid parameter of hydraulic fluid pumped by the thrust pump; and a third sensor that outputs a third parameter signal indicative of a third hydraulic fluid parameter of hydraulic fluid pumped by the mud pump, wherein processor execution of the stored program instructions causes the control circuitry to calculate the rotation pump power draw based on the first parameter signal, calculate the thrust pump power draw based on the second parameter signal, and calculate the mud pump power draw based on the third parameter signal.

9. The horizontal direction drilling machine of claim 8, wherein the first hydraulic fluid parameter is hydraulic fluid flow rate output by the rotation pump, the second hydraulic fluid parameter is hydraulic fluid flow rate output by the thrust pump, and the third hydraulic fluid parameter is hydraulic fluid flow rate output by the mud pump.

10. The horizontal direction drilling machine of claim 7, wherein processor execution of the stored program instructions causes the control circuitry to decrease mechanical energy draw of each of the rotation pump, the thrust pump, and the mud pump from the engine in equal portion based on the total power draw exceeding the threshold.

11. The horizontal direction drilling machine of claim 7, further comprising a user interface comprising a rotation input configured to output a rotation command signal, a thrust input command signal, and a mud input command signal, wherein processor execution of the stored program instructions causes the control circuitry to control the energy draw of the rotation pump based on the rotation command signal, control the energy draw of the thrust pump based on the thrust command signal, and control the energy draw of the mud pump based on the mud command signal, wherein the energy draw of the rotation pump, the energy draw of the thrust pump, and the energy draw of the mud pump are each moderated from user input levels by the control circuitry based on the total power draw exceeding the threshold.

12. The horizontal directional drilling machine of claim 7, further comprising an engine coolant temperature sensor configured to output a temperature signal indicative of coolant fluid temperature of the engine, wherein processor execution of the stored program instructions causes the control circuitry to decrease mechanical energy draw of each of the rotation pump, the thrust pump, and the mud pump from the engine if the coolant fluid temperature exceeds a temperature threshold based on the temperature signal.

13. A method for controlling pump power draw from an engine in a horizontal directional drilling machine, the method comprising:

providing a directional drilling machine having an engine that outputs mechanical energy, a rotation pump that draws upon the mechanical energy output by the engine to operate a rotation motor that rotates a drill string, a thrust pump that draws upon the mechanical energy output by the engine to operate a thrust motor that longitudinally moves the drill string, a mud pump that draws upon the mechanical energy output by the engine to operate a mud motor that delivers fluid through the drill string;

sensing a first signal indicative of a first hydraulic fluid parameter of hydraulic fluid pumped by the rotation pump;

sensing a second signal indicative of a second hydraulic fluid parameter of hydraulic fluid pumped by the thrust pump;

sensing a third signal indicative of a third hydraulic fluid parameter of hydraulic fluid pumped by the mud pump;

determining a rotation pump power draw from the mechanical energy output by the engine based on the first signal;

determining a thrust pump power draw from the mechanical energy output by the engine based on the second signal;

determining a mud pump power draw from the mechanical energy output by the engine based on the third signal;

determining a total pump power draw based on the rotation pump power draw, the thrust pump power draw, and the mud pump power draw;

comparing the total pump power draw to a threshold associated with output capacity of the engine; and decreasing power draw of each of the rotation pump, the thrust pump, and the mud pump from the engine based on the total pump power draw exceeding the threshold, wherein decreasing power draw from the engine for each of the rotation pump, the thrust pump, and the mud pump further comprises decreasing power draw in unequal portion between the rotation pump, the thrust pump, and the mud pump.

14. The method of claim 13, wherein the first hydraulic fluid parameter is hydraulic fluid flow rate output by the rotation pump, the second hydraulic fluid parameter is hydraulic fluid flow rate output by the thrust pump, and the third hydraulic fluid parameter is hydraulic fluid flow rate output by the mud pump.

15. The method of claim 13, wherein decreasing power draw from the engine for each of the rotation pump, the thrust pump, and the mud pump further comprising decreasing power draw in equal portion between the rotation pump, the thrust pump, and the mud pump.

16. The method of claim 13, further comprising:

receiving a rotation input parameter from a first user manipulated input;

receiving a thrust input parameter from a second user manipulated input;

receiving a mud input parameter from a third user manipulated input;

controlling power draw by the rotation pump from the engine based on the rotation input parameter;

controlling power draw by the thrust pump from the engine based on the thrust input parameter;

controlling power draw by the mud pump from the engine based on the mud input parameter; and modifying each of the rotation input parameter, the thrust input parameter, and the mud input parameter to decrease power draw of each of the rotation pump, the thrust pump, and the mud pump from the engine based on the total power energy draw exceeding the threshold.

17. The system of claim 13, further comprising:

receiving a engine coolant temperature signal indicative of engine coolant temperature of the engine; and decreasing energy draw of each of the rotation pump, the thrust pump, and the mud pump from the engine based on the coolant fluid temperature exceeding a temperature threshold based on the engine coolant temperature signal.

18. A horizontal directional drilling machine having power control, comprising:

an engine that outputs mechanical energy;

a rotation pump that draws upon the mechanical energy output by the engine to operate a rotation motor that rotates a drill string;

a thrust pump that draws upon the mechanical energy output by the engine to operate a thrust motor that longitudinally moves the drill string;

a mud pump that draws upon the mechanical energy output by the engine to operate a mud motor that delivers fluid through the drill string;

means for calculating a rotation pump power draw from the engine;

means for calculating a thrust pump power draw from the engine;

means for calculating a mud pump power draw from the engine;

means for calculating a total power draw based on the rotation pump power draw, the thrust pump power draw and the mud pump power draw;

means for comparing the total power draw to a threshold; and means for decreasing mechanical energy draw of each of the rotation pump, the thrust pump, and the mud pump from the engine based on the total power draw exceeding the threshold, the means for decreasing mechanical energy draw comprising means for decreasing power draw from the engine for each of the rotation pump, the thrust pump, and the mud pump in unequal portion between the rotation pump, the thrust pump, and the mud pump.

* * * * *